US009357284B2

(12) United States Patent
Bacino

(10) Patent No.: US 9,357,284 B2
(45) Date of Patent: May 31, 2016

(54) WIRE COIL RETAINER

(71) Applicant: John E Bacino, Landenberg, PA (US)

(72) Inventor: John E Bacino, Landenberg, PA (US)

(73) Assignee: EzLutions LLC, Kemblesville, PA (US)

( * ) Notice: Subject to any disclaimer, the term of this patent is extended or adjusted under 35 U.S.C. 154(b) by 108 days.

(21) Appl. No.: 14/070,580

(22) Filed: Nov. 4, 2013

(65) Prior Publication Data

US 2015/0121659 A1 May 7, 2015

(51) Int. Cl.
*H04R 1/10* (2006.01)

(52) U.S. Cl.
CPC ..... *H04R 1/1033* (2013.01); *Y10T 24/14* (2015.01)

(58) Field of Classification Search
CPC ..... H04R 1/1033; H02G 11/02; H02G 11/00; B65H 2701/526; Y10T 24/14; Y10T 24/39; Y10T 24/32; A44B 18/00; A47B 2097/003; A47B 21/06; F16G 11/00; F16G 11/10; F16G 11/14; Y10S 242/916
See application file for complete search history.

(56) References Cited

U.S. PATENT DOCUMENTS 2,985,480 A * 5/1961 Otley ..... B66C 1/18 105/354
4,802,638 A 2/1989 Burger
4,815,172 A 3/1989 Ward
5,498,047 A * 3/1996 Treuling ..... B66C 1/18 294/74
5,642,739 A * 7/1997 Fareed ..... A61F 5/0118 128/878
5,682,653 A * 11/1997 Berglof ..... G09F 1/10 224/183
D456,692 S 5/2002 Epstein
D522,849 S 6/2006 Dick et al.
D587,988 S 3/2009 Johansson
D600,673 S 9/2009 Kim et al.
D601,879 S 10/2009 Kim et al.
7,712,696 B2 5/2010 Loh
7,817,002 B2 * 10/2010 Fullerton ..... A45F 5/02 2/312
8,139,809 B2 3/2012 Jubelirer et al.
8,261,416 B2 9/2012 Rothbaum et al.
D676,021 S 2/2013 Stevinson
8,399,769 B2 3/2013 Doll
2002/0073516 A1 6/2002 Behar
2004/0010178 A1 * 1/2004 Buckner ..... A61F 7/007 600/9
2005/0148313 A1 7/2005 Chee
2007/0180665 A1 8/2007 Sween et al.
2008/0041897 A1 * 2/2008 Malhotra ..... A45C 11/00 224/199
2008/0168970 A1 * 7/2008 Tilby ..... F41B 5/1469 124/35.2
2010/0083699 A1 * 4/2010 Conigliaro ..... A44C 15/003 63/1.18
2010/0224714 A1 9/2010 Winther et al.
2012/0324631 A1 * 12/2012 Peper ..... A41F 15/02 2/244

* cited by examiner

*Primary Examiner* — Robert J Sandy
*Assistant Examiner* — David Upchurch
(74) *Attorney, Agent, or Firm* — Invention To Patent Services; Alex Hobson

(57) ABSTRACT

A wire coil retainer having a band with at least one fastening feature configured to detachably attach one side of the band to the other side of the band that allows for quick and easy retention of a wire coil, such as a headphone wire. When the fastening feature is attached, two opposing loops are formed on either side of the fastener. A wire coil can be retained by placing the wire coil inside the interior of the band and detachably attaching the fastening feature through the center coil opening. A first portion of the wire coil is retained in a first loop and a second portion of the wire coil is retained in a second loop of the fastened wire coil retainer. A wire coil retainer may be configured with one or more retainer protrusions that aid in the retention of a wire coil within a loop.

16 Claims, 18 Drawing Sheets

WIRE COIL RETAINER

BACKGROUND OF THE INVENTION

1. Field of the Invention

The present invention relates to a wire coil retainer having detachably attachable fastening feature.

2. Background

Wires and cords extending from the various electronic devices commonly used today easily become tangled when being packed and unpacked. Headphone wires, for example, are often stuffed into a person's pocket, backpack, pocketbook, purse or gym bag and become tangled requiring them to be carefully untangled before the next use. In addition, when wearing headphones during a work-out, such as running on a treadmill, the wires extending from a set of headphones can be too long and interfere with the activity or get caught on equipment.

There exists a need for a device that will facilitate the quick and easy retention of a wire such that it will not become tangled and is easy to use.

SUMMARY OF THE INVENTION

The invention is directed to a wire coil retainer that comprises a band with at least one fastening feature configured to detachably attach one side of the band to the other side. When the fastening feature is attached, two opposing loops are formed on either side of the fastener. A wire coil, such as headphone wires, can be retained by placing the wire coil inside the interior of the band and fastening the fastening feature through the center coil opening. A first portion of the wire coil is retained in a first loop and a second portion of the wire coil is retained in a second loop of the fastened wire coil retainer. For example, headphone wires may be formed into a coil by wrapping them around one or more fingers. The coil may then be inserted through the center of the band and the fastening feature attached. The outer coil perimeter is retained in the interior of the band and the fastening feature is attached through the center of the coil, or the coil opening. When headphone use is desired, the wire coil retainer can be quickly opened, and the wire coil removed.

An exemplary wire coil retainer comprises a contiguous band that forms a continuous loop and may not be separated. An exemplary continuous band is a one-piece unit that is not separable into pieces or configured to be broken about the circumference. A band, as described herein, may be made of any suitable material such that it may be flexed to bring one side of the band in contact with the opposing side of the band. An exemplary band is substantially more flexible in the loop plane than it is in the cross-loop plane. For example, a rubber band can be flexed easily in the loop plane but is significantly more rigid in the cross loop plane. In an exemplary embodiment, a band consists of a rubber or elastomer material.

A band, as described herein, comprises an interior, or opening area within the band, an inside surface and a circumference. A band may have any suitable circumference including, but not limited to, about 30 inches or more, about 20 inches or more, about 15 inches or more, about 10 inches or more, about 5 inches or more, no more than about 30 inches, no more than about 10 inches and any range between and including the circumferences provided. A band, as described herein, may have any suitable width including, but not limited to, about 0.25 inches or more, about 0.5 inches or more, about 0.75 inches or more, about 1.0 inches or more, about 2.0 inches or more, no more than about 2.0 inches, and any range between and including the width values provided. A band may have any suitable thickness including, but not limited to, about 0.125 inches or more, about 0.25 inches or more, about 0.5 inches or more, no more than 0.5 inches and any range between and including the thickness values provided. A band may have substantially the same thickness around the entire circumference of the band.

The wire coil retainer, as described herein, comprises a fastening feature that is configured to detachably attach a first side of the band to a second side of the band to create a first loop and a second loop. A band may comprise one or more fastening features and each fastening feature may comprise a first fastener portion on a first side of the band and a second fastener portion on a second side of the band. For example, a first fastener portion may be a male snap and a second fastener portion may be a female snap. The male snap may be pushed into the female snap to attach a first side of the band to the second side of the band. Two loops will be formed on either side of the fastening feature when it is fastened. A second fastener portion may be configured approximately one-half the band circumference from the first fastener portion, thereby forming two substantially equally sized loops when fastened.

A magnetic fastener allows one or both fastener portions to be configured on the outside surface of the band or at least partially embedded within the band. A magnet will attract another magnet or magnetic metal through a rubber or plastic band for example. One or both of the fastener portions maybe configured on the outside surface of the band, on the inside surface of the band, at least partially embedded in the band, or any combination thereof. In one embodiment, a fastener comprises a magnet that is configured on the outside surface of a first side of a band and a magnetic metal configured on the inside surface of a second side of a band. In another embodiment, a band comprises first and second magnet portions embedded completely within the band on opposing sides, whereby the band has a smooth outer surface, including the inside and outside surfaces that do not have a fastener protruding from the surface. A band may have a non-uniform thickness however, whereby the band is thicker where an embedded or partially embedded fastener portion is located. Coupled magnets may have any suitable pull-apart force including, but not limited to, about 1 lb-force or more, about 2 lb-force or more, about 3 lb-force or more, about 5 lb-force or more, about 7 lb-force or more and any range between and including the pull apart forces listed. A pull-apart force is the force required to pull two of the same type and coupled magnets apart.

A fastening feature, as described herein, is configured to detachably attach a first side of the band to a second side of the band. A fastening feature may be a push-pull type, requiring only pushing together and pulling apart of the band to attach and detach the fastener respectively. Push-pull type fasteners include magnets, snaps, and hook-and-loop fasteners and the like. Other fasteners, such as those that require additional manipulation of the fastener, may be used as well.

In an exemplary embodiment, a fastener comprises a magnet. A first fastener portion may be a magnet and a second fastener portion may be magnetic metal, or a metal that is attracted to a magnet. In another embodiment, a first fastener portion is a magnet, and a second fastener portion is also a magnet that is configured with an opposing polarity facing the first magnet.

A fastener may comprise a hook-and-loop fastener, such as Velcro, for example. A first fastener portion may comprise a loop portion of a hook-and-loop fastener and a second fastener portion may comprise a hook portion of a hook-and-loop fastener.

A fastener may be attached to the inside surface of a band, or may be incorporated into the band. A magnet or magnetic metal may be at least partially embedded within the band material for example. In an exemplary embodiment, a band consists of a rubber material that is molded around a magnet fastener, whereby no portion of the magnet is exposed.

A band may comprise one, two, three or more fasteners, and each fastener may comprise a first and second fastener portion. In an exemplary embodiment, a wire coil retainer has only one fastener feature that is centrally located, whereby the distance along the circumference of band, between the first and second fastener portions, is equal.

A wire coil retainer may comprise one or more retainer protrusions configured on the inside surface of the band. A retainer protrusion may aid in pinching and retaining a wire coil. A retainer protrusion may have any suitable shape, such as triangular, square, polygonal, irregularly shaped and the like. Retainer protrusions may be configured in any suitable location on the band, such as along the inside surface. A plurality of retainer protrusions may be configured on a first side and on an opposing second side, whereby when the wire coil retainer is fastened and the retainer protrusions approach each other to pinch a wire retained therein.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
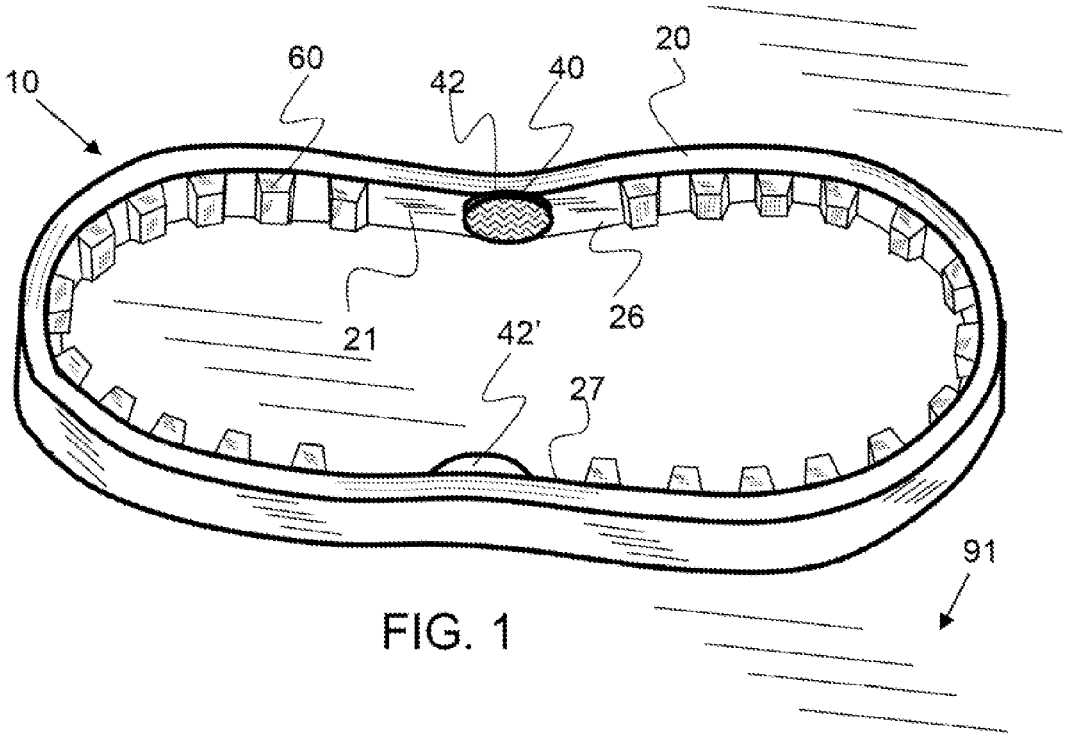

FIG. 1 shows a perspective view of an exemplary wire coil retainer comprising a fastening feature and a plurality of retainer protrusions extending from the inside surface.

Figure 2:
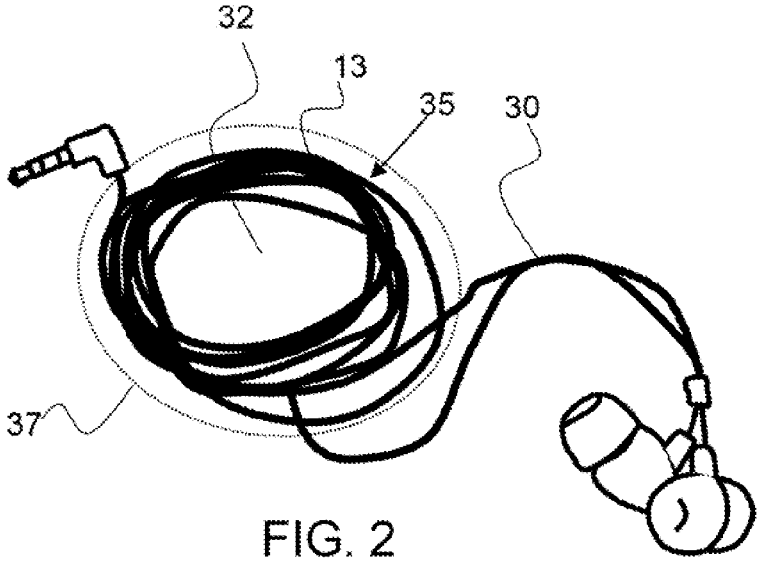

FIG. 2 shows a wire coil of a headphone set.

Figure 3:
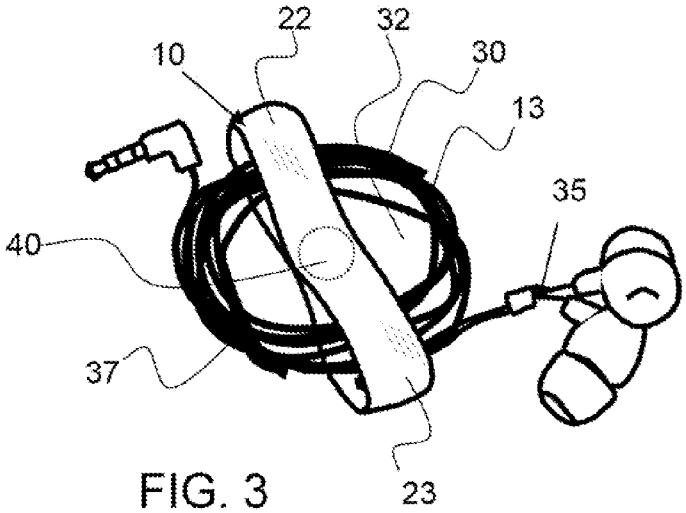

FIG. 3 shows the wire coil of a headphone set being retained by an exemplary wire coil retainer as described herein.

Figure 4:
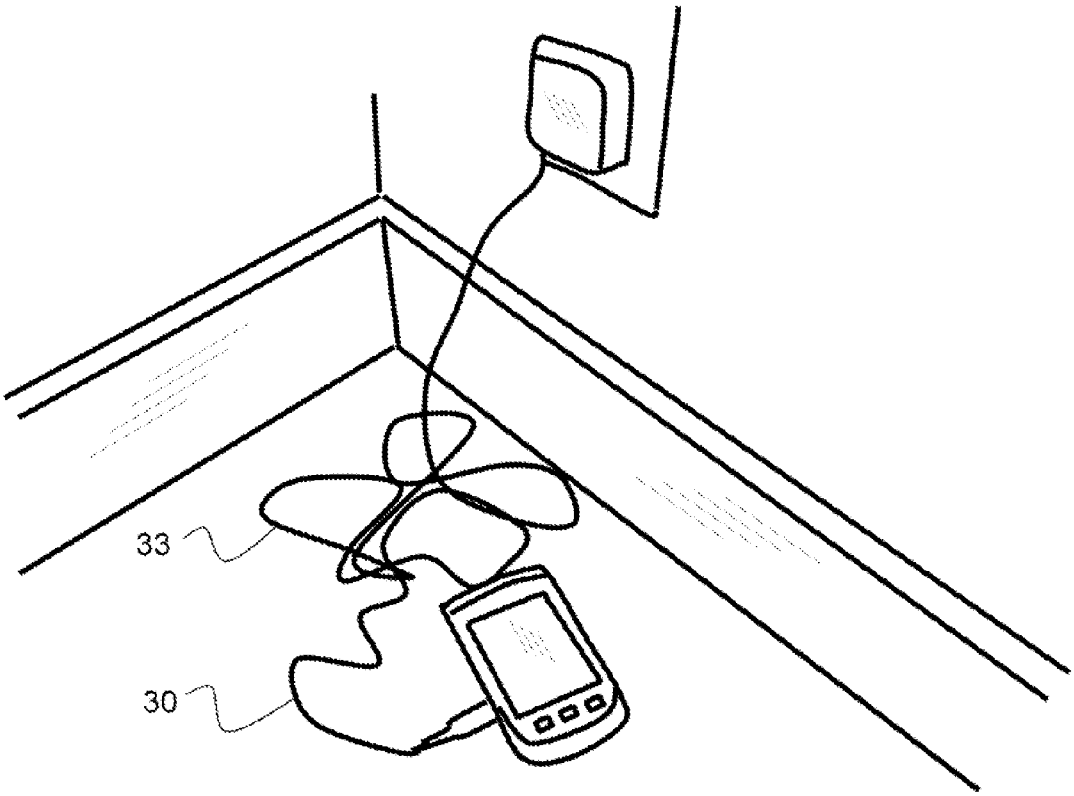

FIG. 4 shows a loose wire from a cellular phone charger cord.

Figure 5:
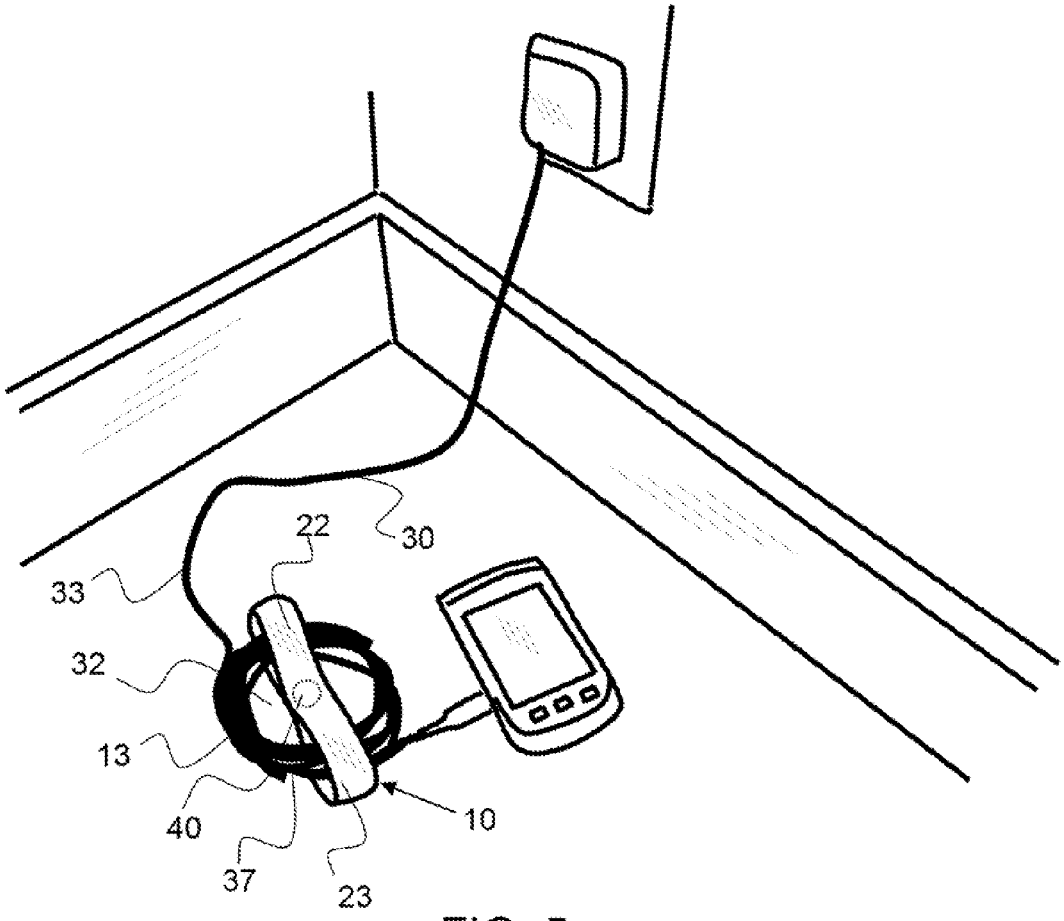

FIG. 5 shows the cellular phone charger cord retained by an exemplary wire coil retainer as described herein.

Figure 6:
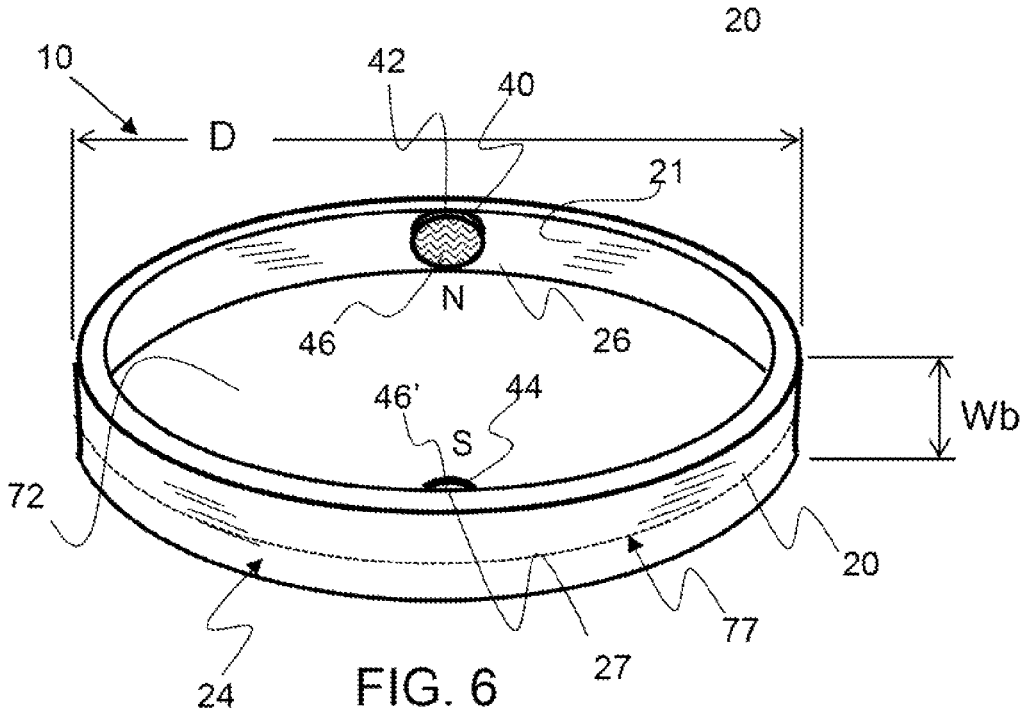

FIG. 6 shows a perspective view of an exemplary ire coil retainer comprising a magnet type fastening feature.

Figure 7:
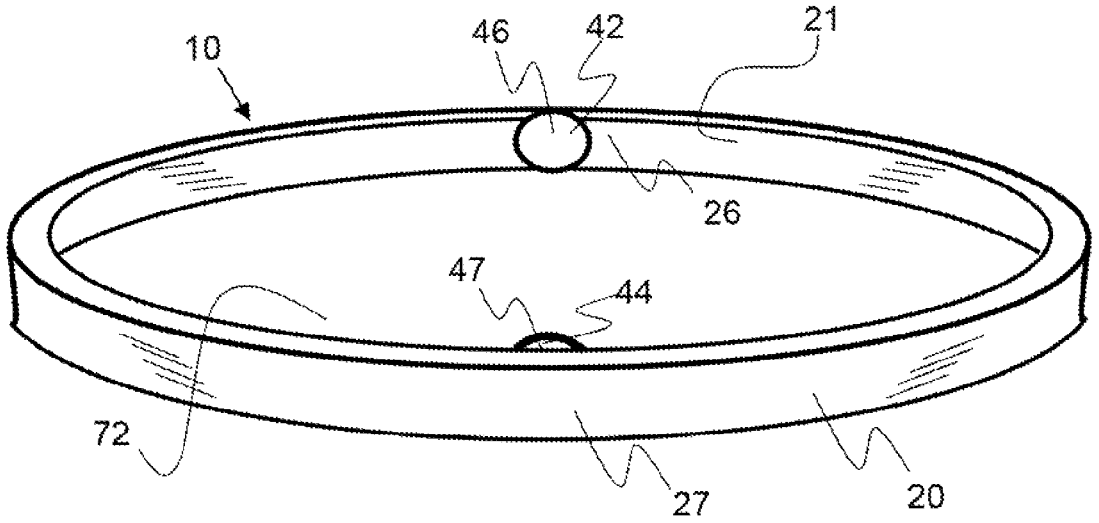

FIG. 7 shows a perspective view of an exemplary wire coil retainer comprising a magnet type fastening feature on a first side and a magnetic metal fastening feature on a second side.

Figure 8:
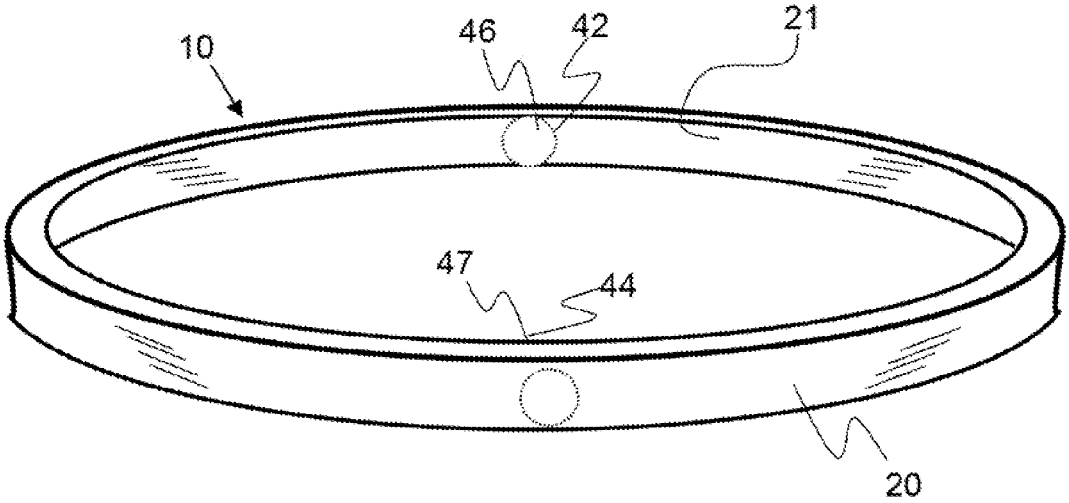

FIG. 8 shows a perspective view of an exemplary wire coil retainer comprising a fastening feature configured within a contiguous band.

Figure 9:
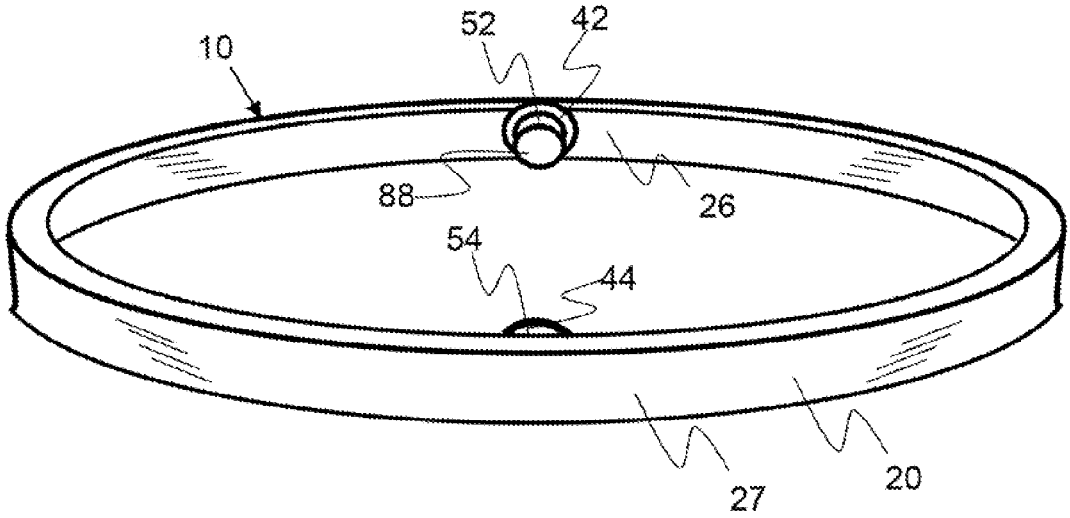

FIG. 9 shows a perspective view of an exemplary wire coil retainer comprising a male snap fastening feature on a first side and a female snap fastening feature on a second side.

Figure 10:
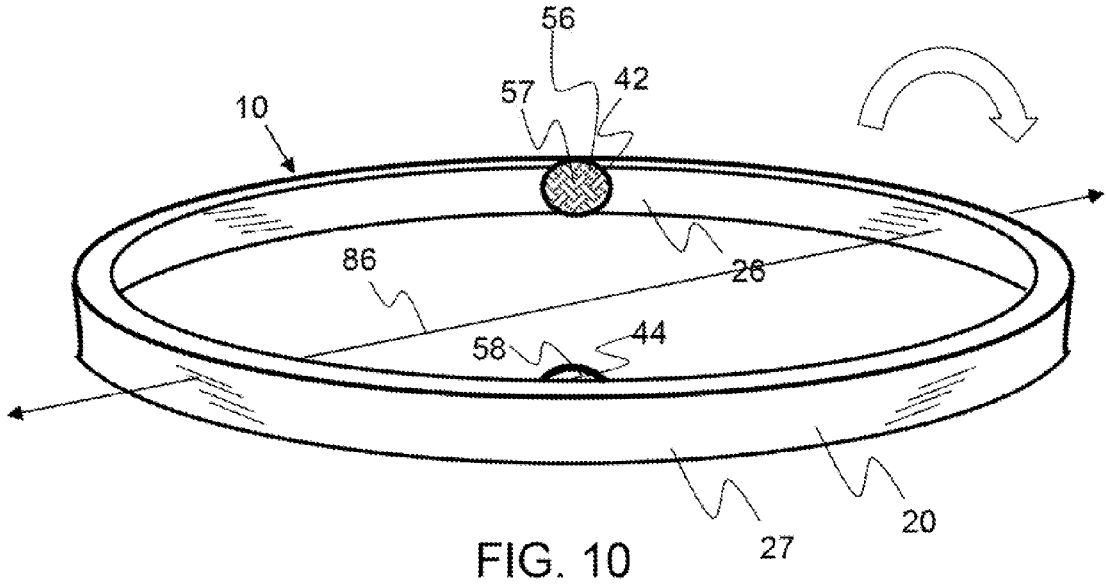

FIG. 10 shows a perspective view of an exemplary wire coil retainer comprising a hook portion of a hook-and-loop fastening feature on a first side and a loop portion of a hook-and-loop fastening feature on a second side.

Figure 11:
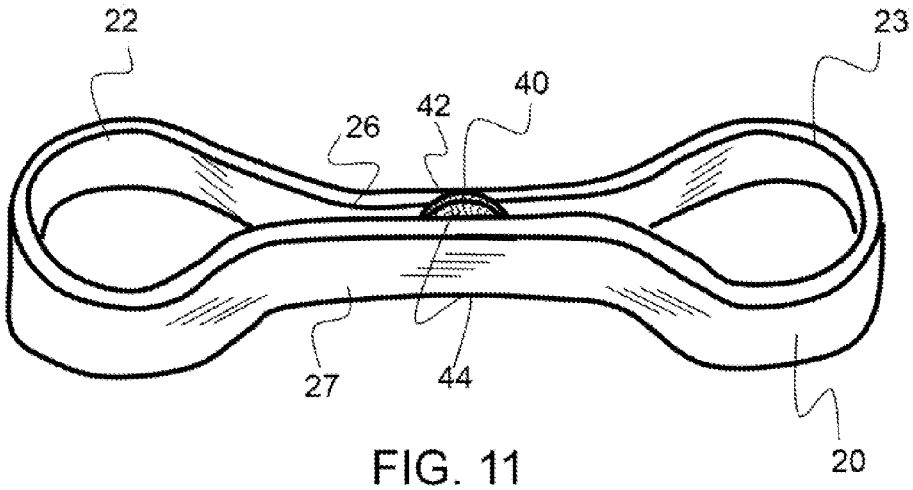

FIG. 11 shows a perspective view of an exemplary wire oil retainer with the fastening feature attaching a first side to a second side.

Figure 12:
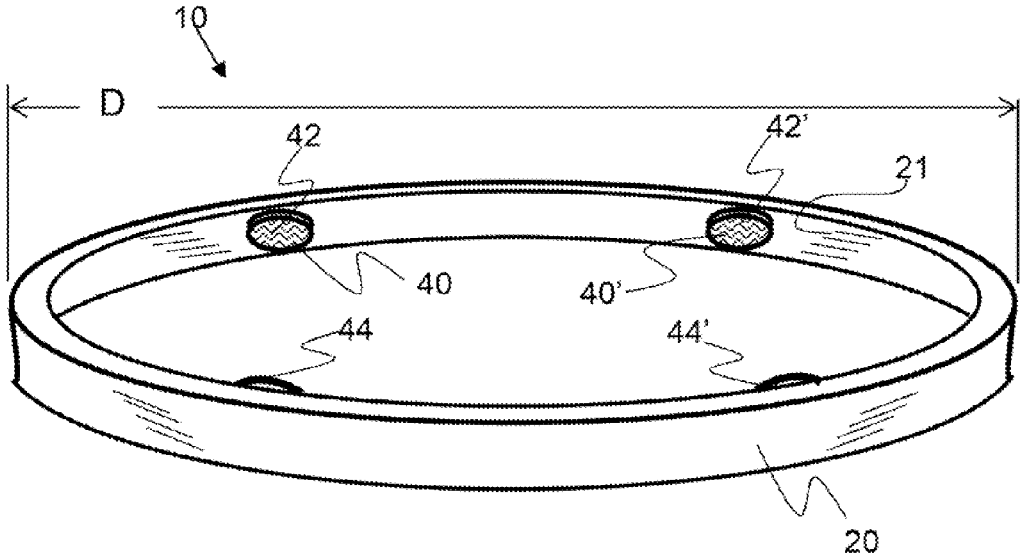

FIG. 12 shows a perspective view of an exemplary wire coil retainer with two fastening features.

Figure 13:
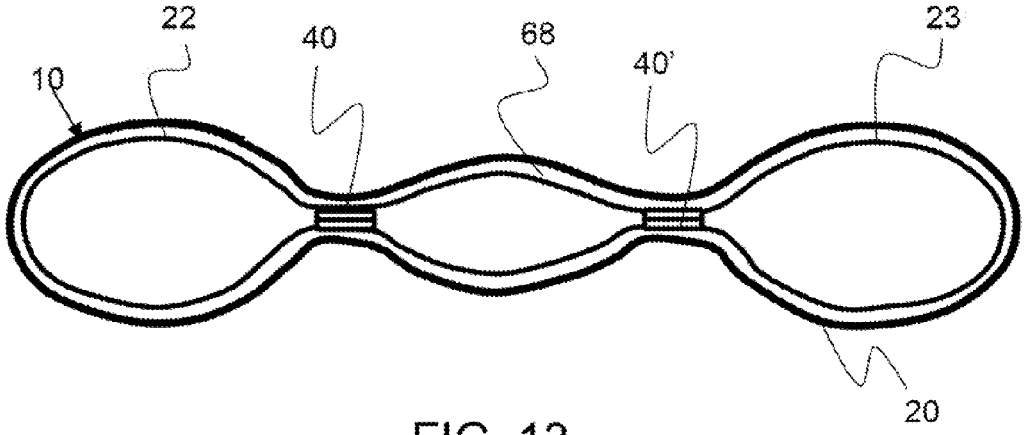

FIG. 13 shows a top-down view of an exemplary wire coil retainer with two fastening features attached forming a first, second and center loop.

Figure 14:
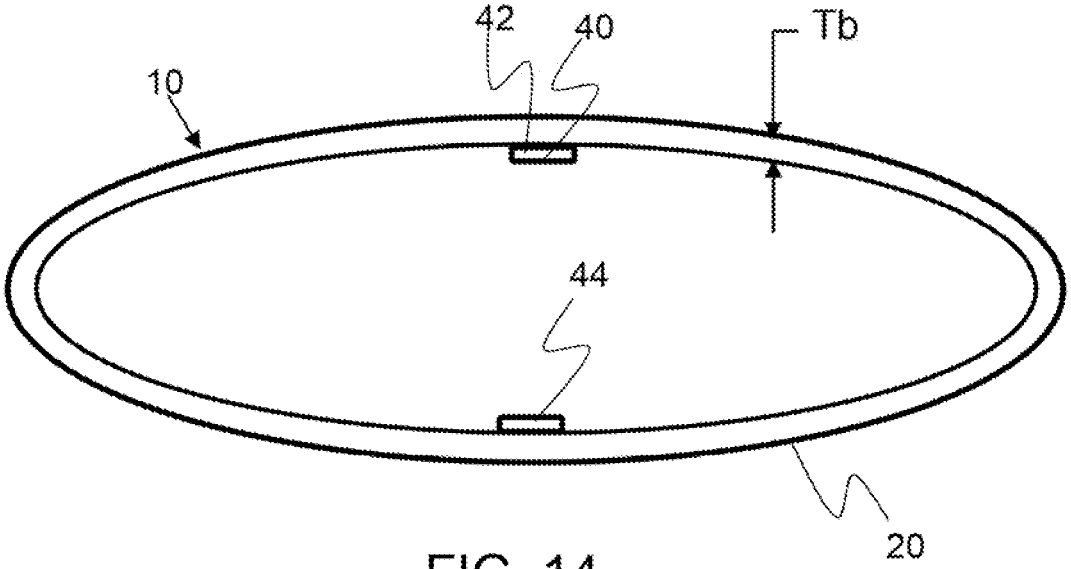

FIG. 14 shows a stop-down view of an exemplary wire coil retainer.

Figure 15:
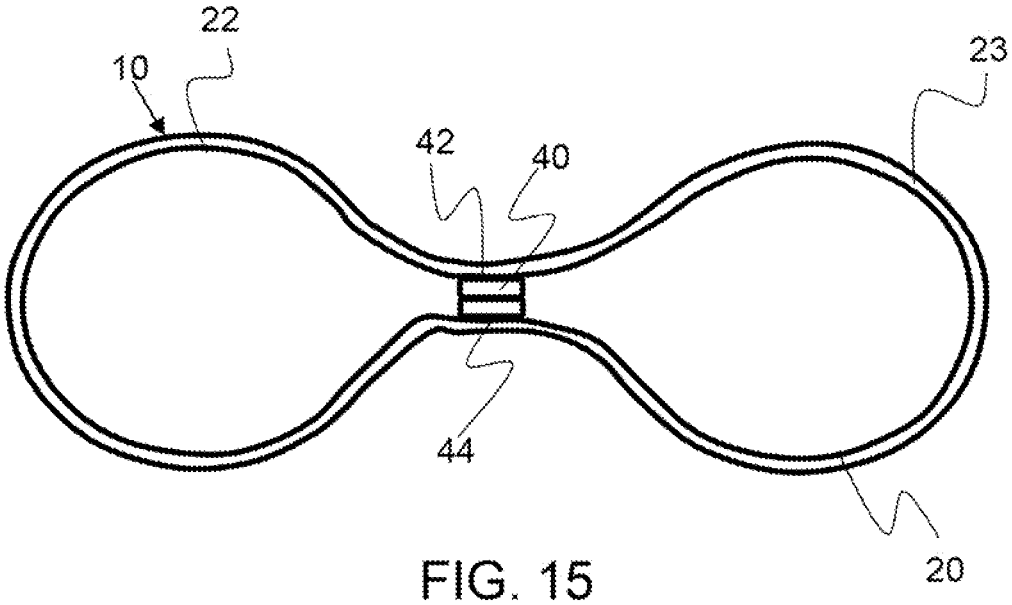

FIG. 15 shows a top-down view of the exemplary wire coil retainer shown in FIG. 14 with the fastening feature attached.

Figure 16:
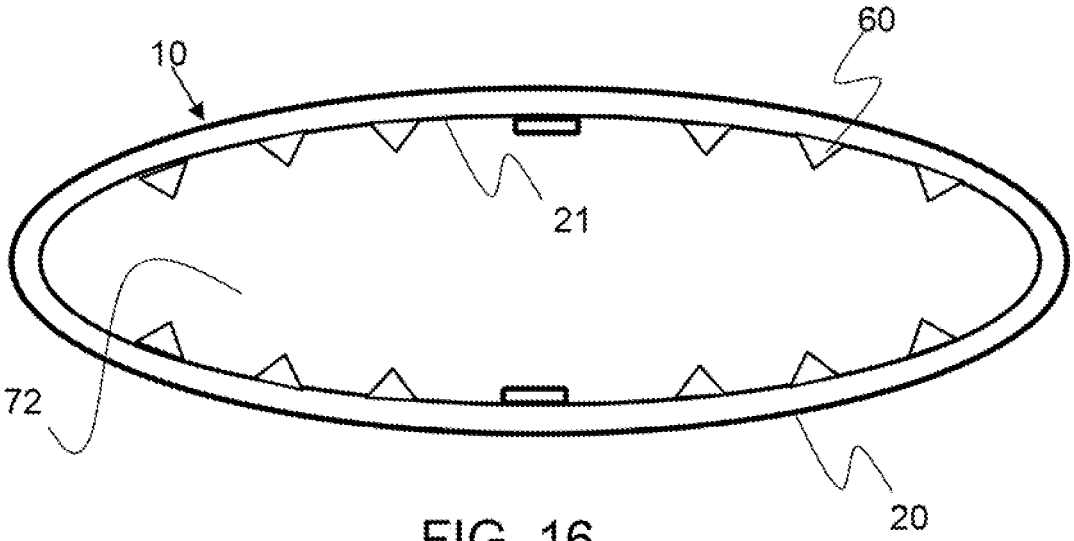

FIG. 16 shows a top-down view of the exemplary wire retainer having retainer protrusions extending from the inside surface.

Figure 17:
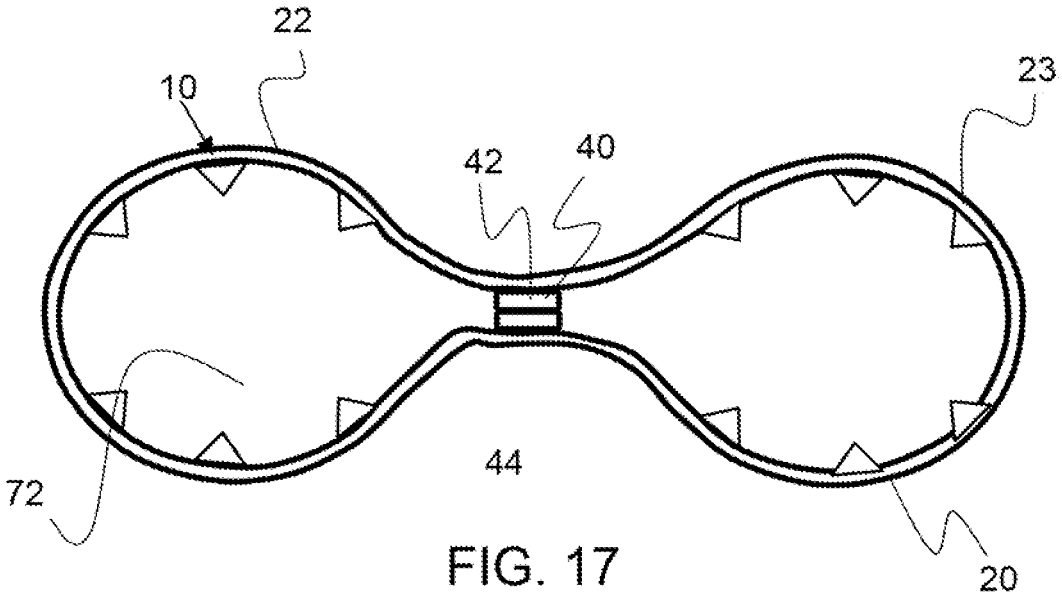

FIG. 17 shows a top-down view of the exemplary wire coil retainer shown in FIG. 16 with the fastening feature attached.)

Figure 18:
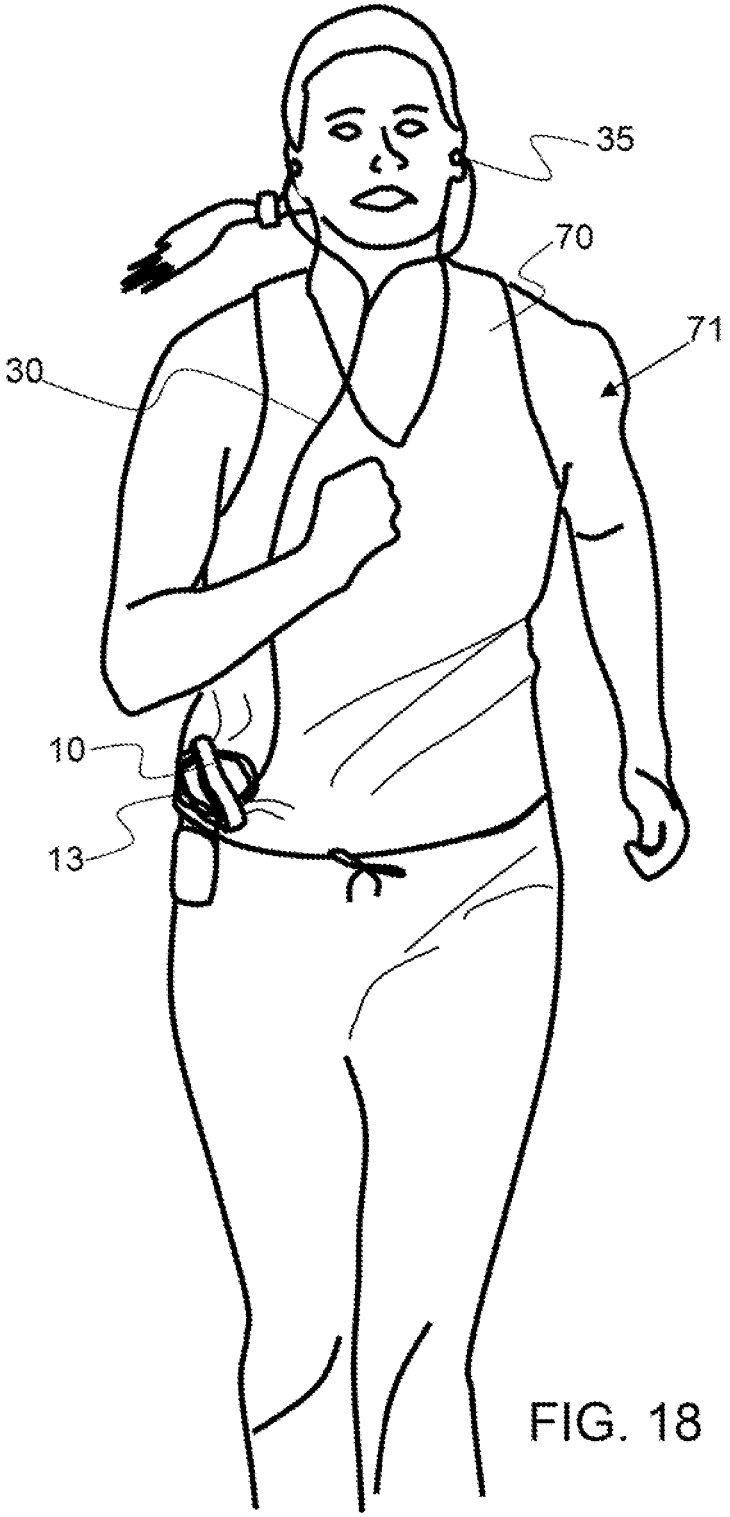

FIG. 18 shows a runner with an exemplary wire coil retainer attached to her shirt.

Figure 19:
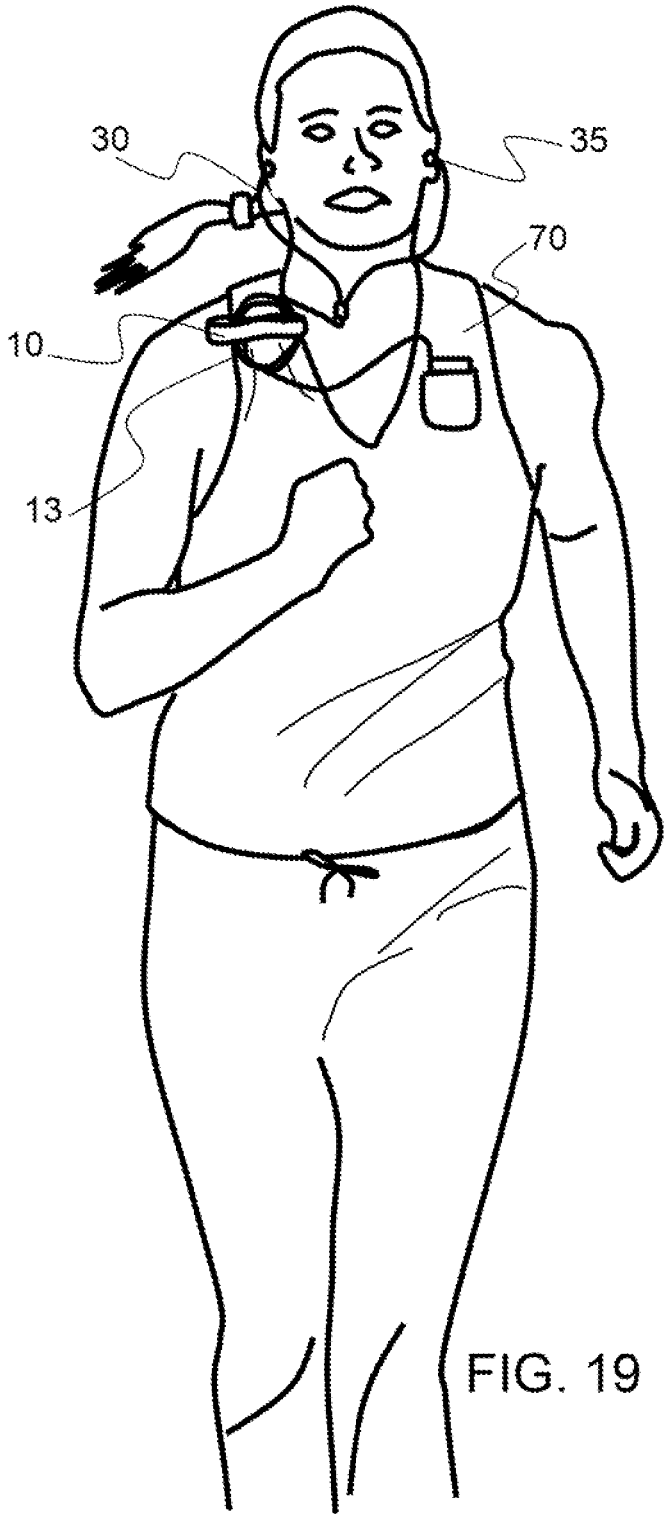

FIG. 19 shows a runner with an exemplary wire coil retainer attached to her shirt.

Figure 20:
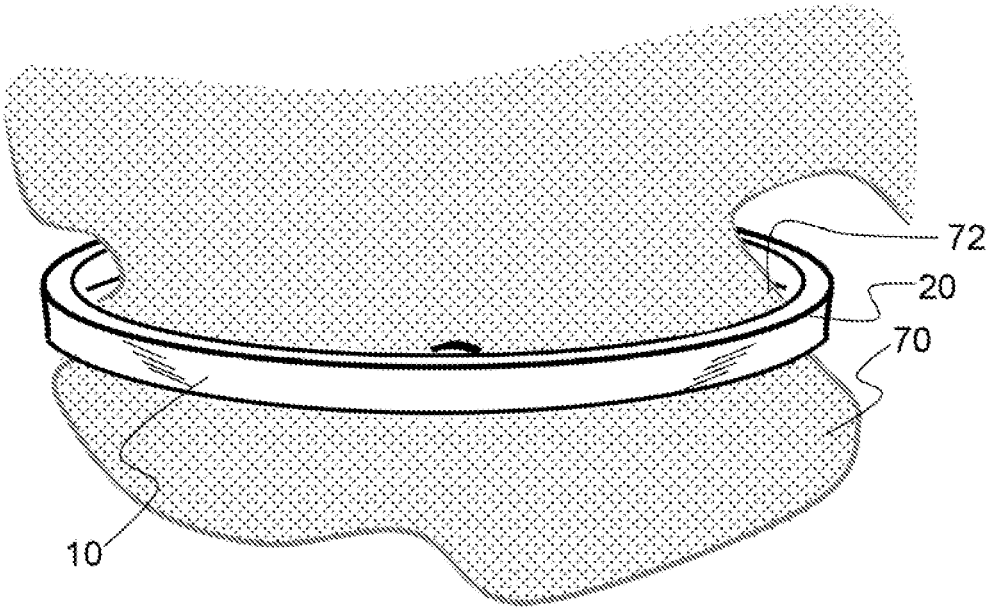
Figure 21:
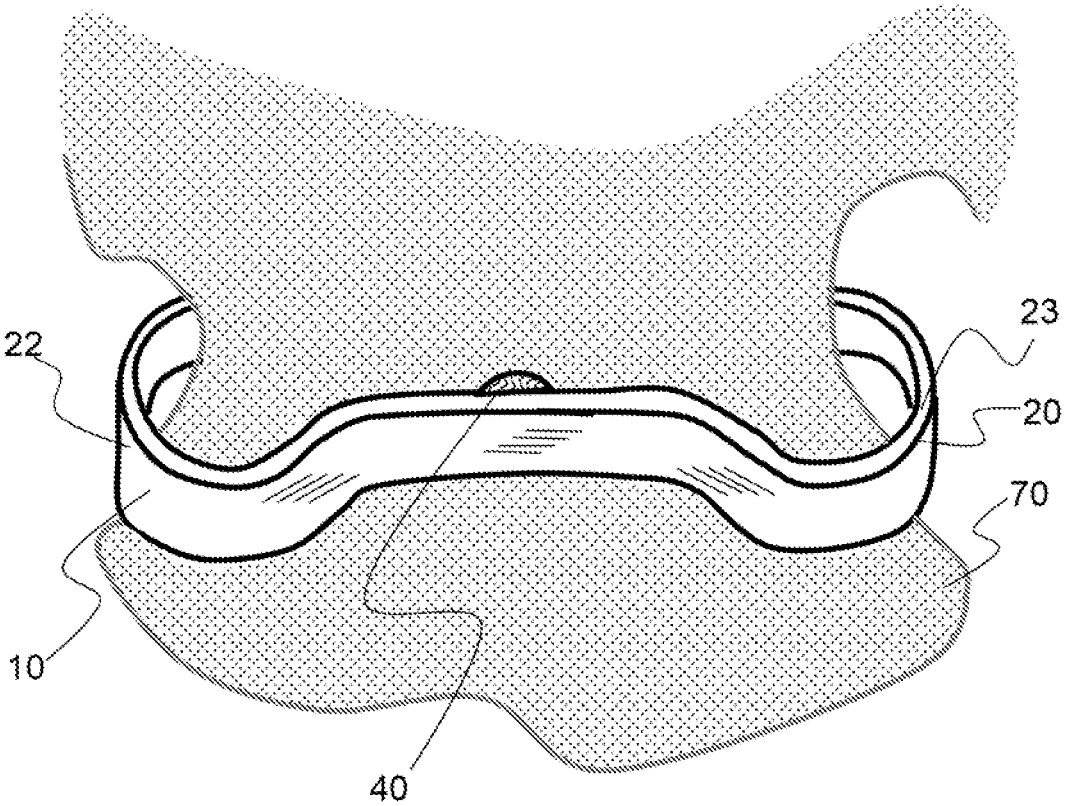

FIG. 20 shows a perspective view of an exemplary wire coil retainer with a portion of a garment pulled through the interior of the contiguous band FIG. 21 shows a perspective view of the exemplary wire coil retainer shown in FIG. 20 with a portion of a garment pulled through the interior of the contiguous band and the fastening feature attached.

Figure 22:
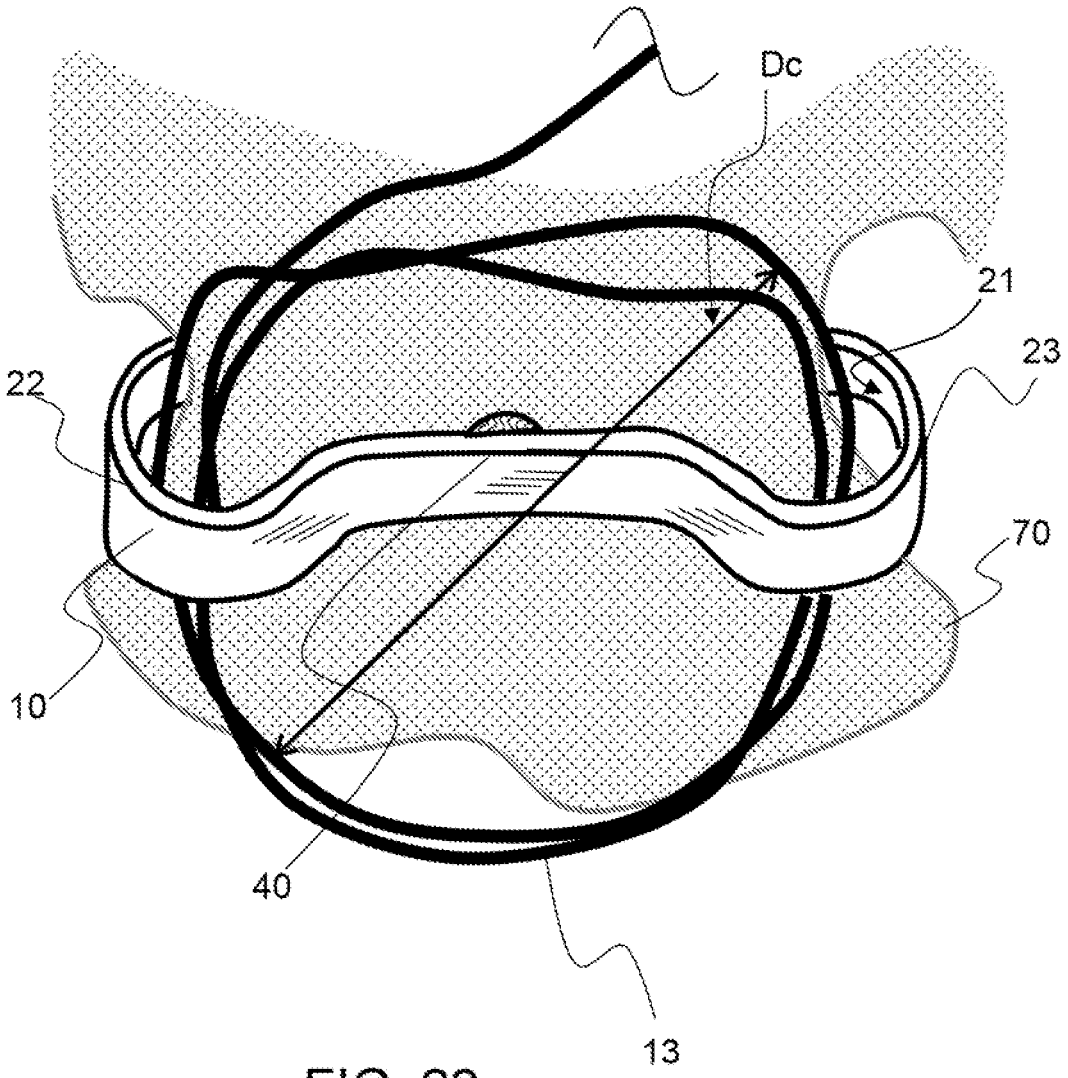

FIG. 22 shows a perspective view of the exemplary wire coil retain shown in FIG. 20 with a portion of a garment pulled through the interior of the contiguous band, a wire coil retained in a first and second loop of the wire coil retainer and the fastening feature attached.

Figure 23:
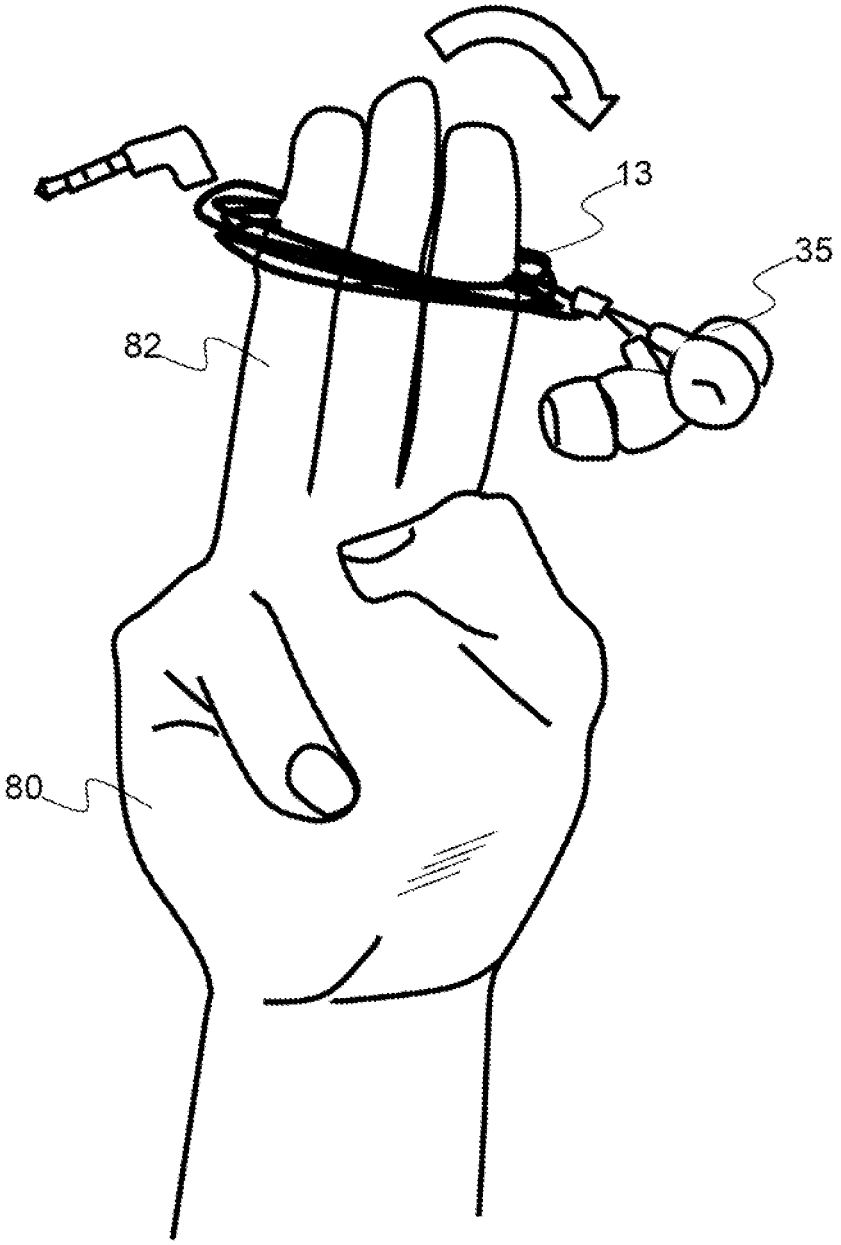

FIG. 23 shows a perspective view of a wire coil being formed around three fingers of a person's hand.

Figure 24:
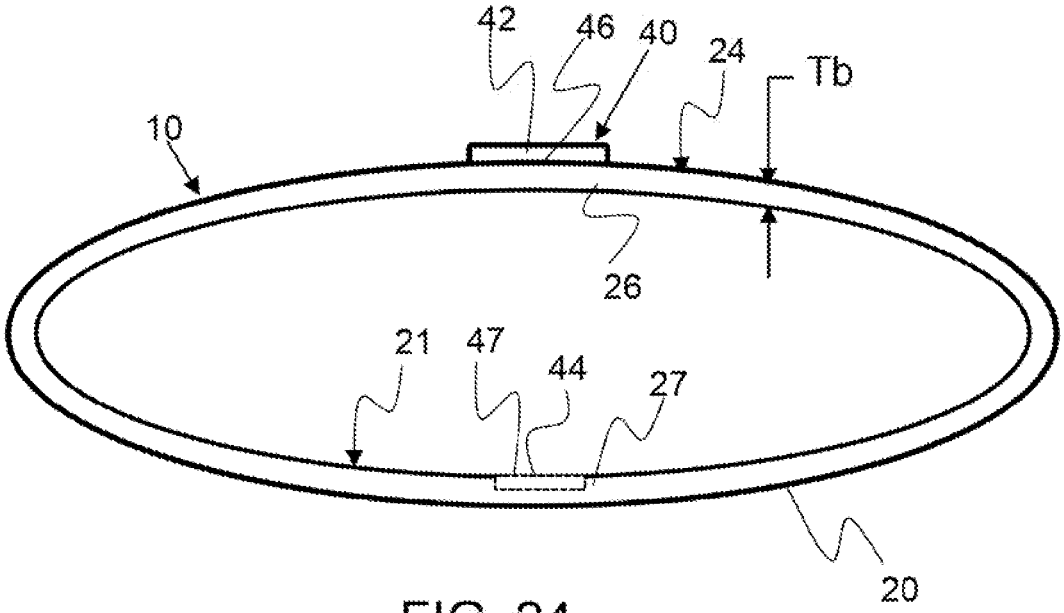

FIG. 24 shows a top-down view of an exemplary wire coil retainer having a magnetic fastener portion on an outside surface of the band and a magnetic metal fastener portion partially embedded into the band material, whereby the magnetic metal fastener portion is flush with the inside surface of the band.

Figure 25:
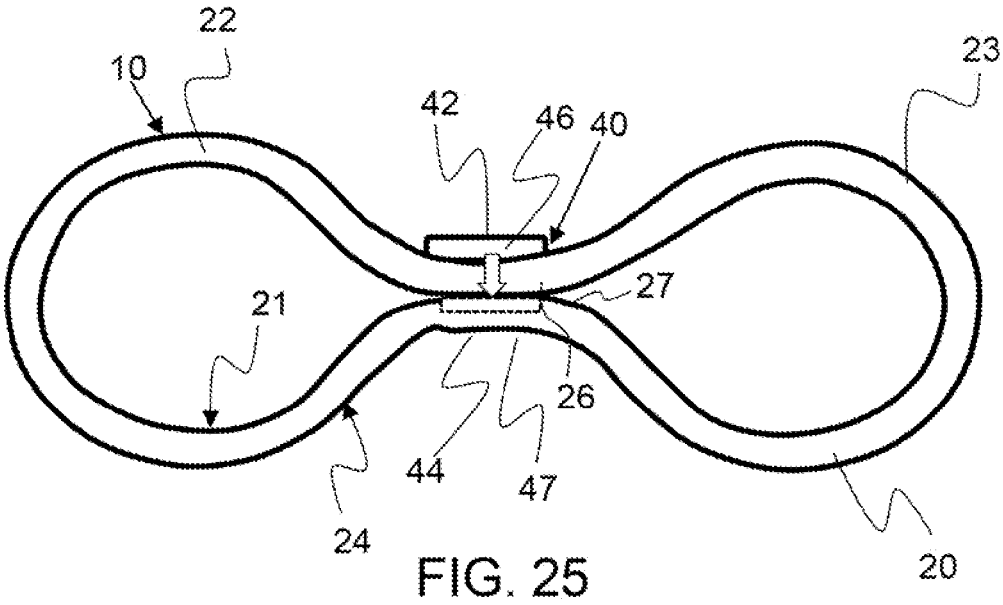

FIG. 25 shows top-down view of the exemplary wire coil retainer shown in FIG. 24 with the fastening feature attached.

Figure 26:
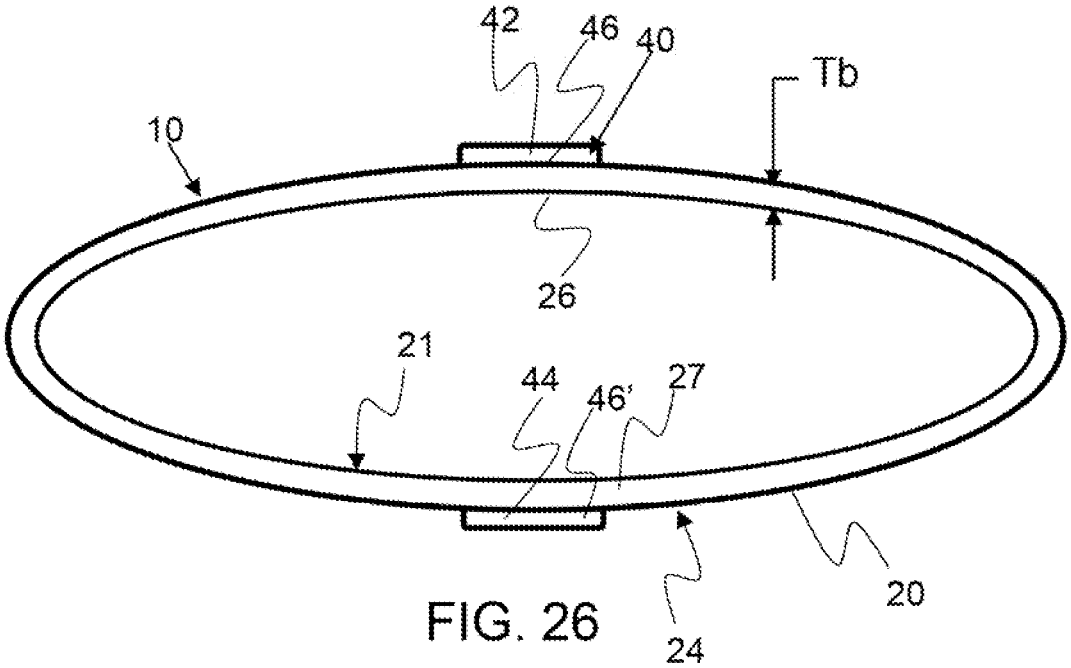

FIG. 26 shows a top-down view of an exemplary wire coil retainer having a first magnetic fastener portion on an first side outside surface of the band and a second magnetic fastener portion on a second side outside surface of the band.

Figure 27:
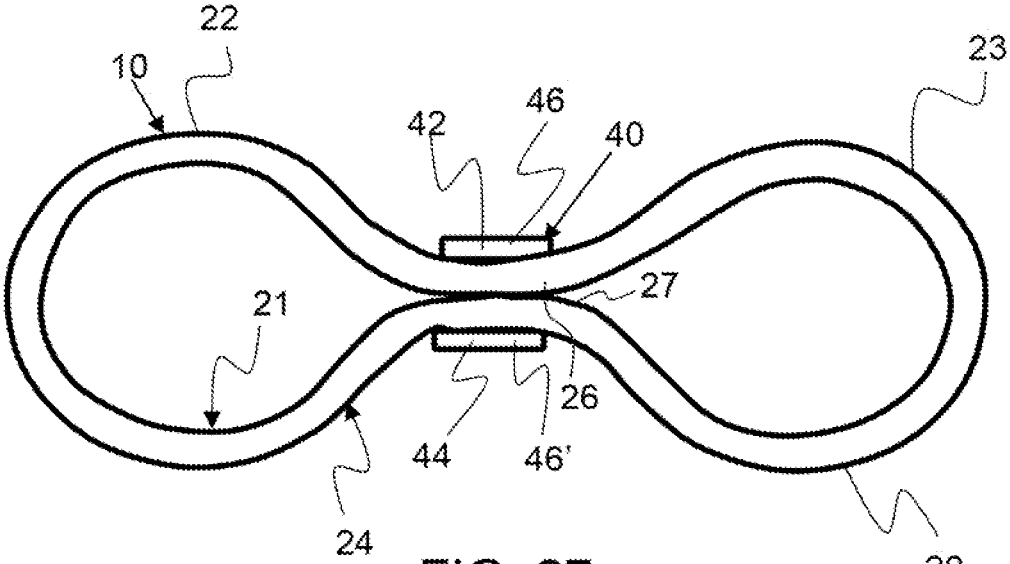

FIG. 27 shows a top-down view of the exemplary wire coil retainer shown in FIG. 26 with the fastening feature attached.

Figure 28:
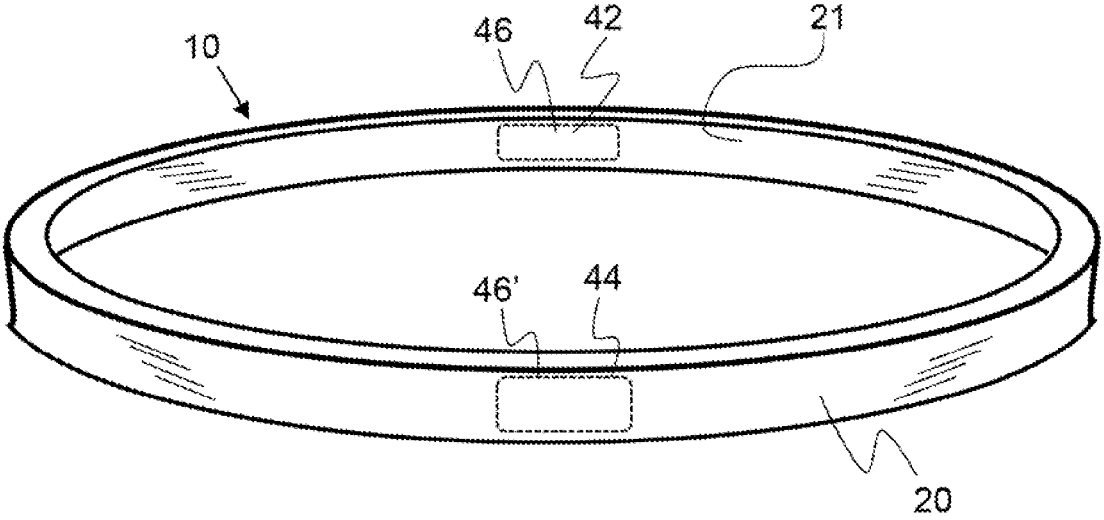
Figure 29:
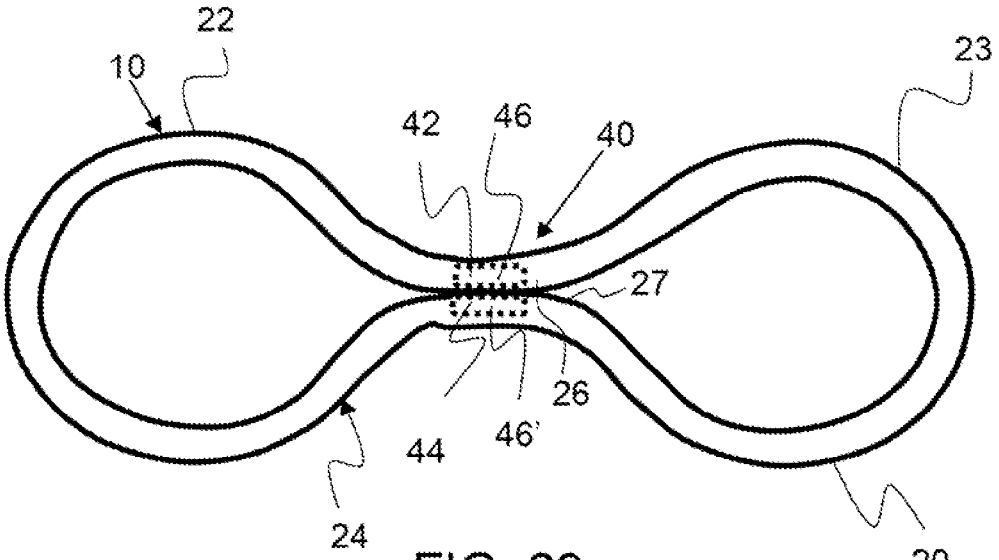

FIG. 28 shows a perspective view of the exemplary wire coil retainer comprising first and second fastener portions that are embedded into the band, FIG. 29 shows a top-down view of the exemplary wire coil retainer shown in FIG. 28 with the fastening feature attached.

Figure 30A:
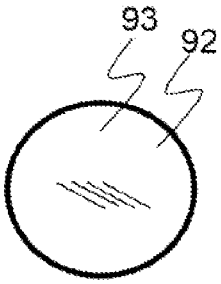

FIG. 30A shows a top-down view of the head of an exemplary post configured to attach a magnet to a band through a band opening.

Figure 30B:
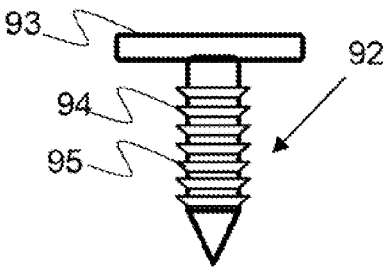

FIG. 30B shows a side view of the exemplary post shown in FIG. 30A.

Figure 31:
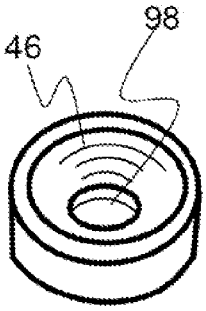

FIG. 31 shows a perspective view of an exemplary magnet having aperture therethrough.

Figure 32:
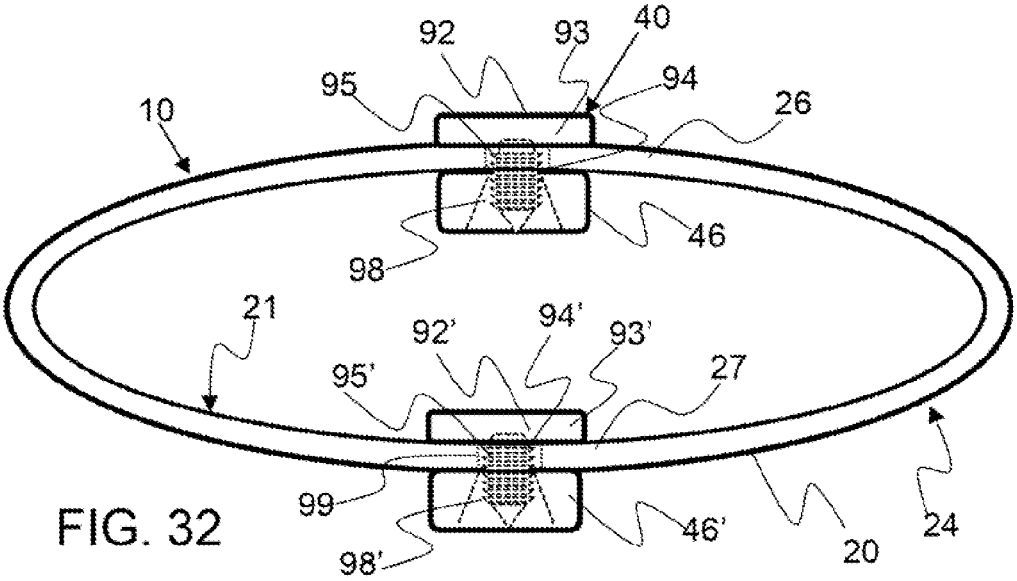

FIG. 32 shows a top-down view of an exemplary wire coil retainer having magnets attached to the band with a post configured through a band opening.

Figure 33:
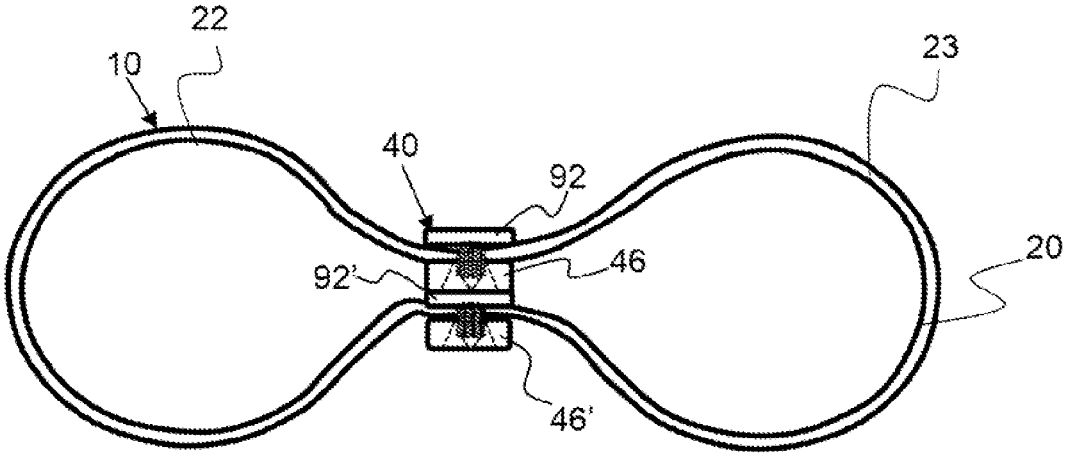

FIG. 33 shows a top-down view of an exemplary wire coil retainer shown in FIG. 32 with the first side of the band attached to the second side of the band.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

A wire coil may be retained following a method including the steps of: forming a wire coil, such as by wrapping a wire around one or more fingers; inserting the wire coil into a wire coil retainer, as described herein; and fastening the fastening feature, whereby a first portion of said wire coil is retained in said first loop and a second portion of said wire coil is retained in said second loop and said center opening of said wire coil is configured over said fastening feature, and whereby the wire coil is retained within said contiguous band.

As shown in FIG. 1, an exemplary wire coil retainer 10 comprises a band 20, a fastening feature 40 and a plurality of retainer protrusions 60 extending from the inside surface 21. The fastening feature comprises a first fastener portion 42 on a first side 26 and a second fastener portion 42' on an opposing second side 27. In an exemplary embodiment, the wire coil retainer is free-standing, meaning that it will retain a generally upright and open geometry as shown in FIG. 1 when placed on a surface 91. The width of the band may stand in a substantially vertical orientation when placed on a surface. The thickness and hardness of the band material may be selected to provide a free-standing band, as shown in FIG. 1.

As shown in FIG. 2, a headphone set 35 comprises a wire coil 13 having a coil opening and coil perimeter 37. The wire 30 is formed into a wire coil having a plurality of loops of wire. The outside perimeter 37 of the wire coil is generally shown by the dashed line around the wire coil 13.

As shown in FIG. 3, a wire coil 13 of a headphone set 35 is retained by an exemplary wire coil retainer 10, as described herein. The outer perimeter 37 of the wire coil is retained within the wire coil retainer 10. A first portion of the wire coil is retained in a first loop 22 and a second portion of the wire coil is retained in a second loop 23 with the fastener 40 attached through the wire coil center opening 32.

As shown in FIG. 4, a cellular phone charger or power cord 33 is loose and not retained. As shown in FIG. 5 the cellular phone power cord 33 is retained by an exemplary wire coil retainer 10. The wire 30 within the wire coil 13 is retained in a first loop 22 and second loop 23.

As shown in FIG. 6, an exemplary wire coil retainer 10 comprises a magnet 46 type fastening feature. The first fastener portion 42 is a magnet 46 with a north-pole facing inward or toward the second fastener portion 44, a magnet 46' with a south pole facing toward the interior 72 of the band 20, or toward the first magnet. The magnets 46, 46 are attached to the inside surface 21 of the band. The width Wb and diameter D of the band are shown. The circumference 77 is the distance around the band as measured along the outside surface 24, As shown in FIG. 7, an exemplary wire coil retainer 10 comprise magnet type fastening feature 46 on a first side 26 and a magnetic metal 47 fastening feature on a second side 27. The magnetic metal is configured approximately one-half the circumference around the band 20 from the magnet.

As shown in FIG. 8, an exemplary wire coil retainer 10 comprises a fastening feature 46, 47 configured within the contiguous band 20. Both the first fastener portion 42 and the second fastener portion 44 are configured within the band material. A magnet and/or magnetic metal may be molded within an elastomeric band material, for example. In one embodiment at least one of the fastener portions is configured within the band material.

As shown in FIG. 9, an exemplary wire coil retainer 10 comprises a male snap 52 first fastener portion 42 on a first side 26 and a female snap 54 second fastener portion 44 on a second side 27. A snap is a push-pull type fastener 88 that requires the first and second fastener portions to be simply pushed together and pulled apart to attach and detach the fastener.

As shown in FIG. 10, an exemplary wire coil retainer 10 comprises a hook portion 57 of a hook-and-loop fastener 56 on a first side 26 and a loop portion 58 of a hook-and-loop fastener on a second side 27. The hoop plane 86 of the band 20 is shown as the double arrow line extending through the band. A band may be configured to be substantially more flexible in the hoop plane than in a cross-direction to the hoop plane, whereby the band can be easily flexed within the hoop plane to attach a first fastener portion 42 to a second fastener portion 44 as shown in FIG. 11, As shown in FIG. 11, an exemplary wire coil retainer 10 has a fastening feature 40 attached, thereby bringing a first side 26 to a second side 27 and forming a first loop 22 and a second loop 23.

As shown in FIG. 12, the wire coil retainer 10 comprises two fastening features 40, 40'. Each fastening feature comprises a first fastener portion 42, 42' and a second fastener portion 44, 44'.

As shown in FIG. 13, the exemplary wire coil retainer 10 shown in FIG. 12 has the two fastening features 40, 40 attached forming a first 22, second 23 and center loop 68.

As shown in FIG. 14, an exemplary wire coil retainer 10 comprises a band 20 having a thickness Tb. The thickness of the band is substantially constant around the circumference of the band.

As shown in FIG. 15, the exemplary wire coil retainer 10 shown in FIG. 14 has the fastening feature 40 attached.

As shown in FIG. 16, an exemplary wire coil retainer 10 has retainer protrusions 60 extending from the inside surface 21 of the band 20. The retainer protrusions are triangular in shape and extend in toward the interior 72 of the band along the hoop plane.

As shown in FIG. 17, the exemplary wire coil retainer 10 shown in FIG. 16 has the fastening feature 40 attached which brings the retainer protrusions in closer proximity to each other.

As shown in FIG. 18, a person 71 running has an exemplary wire coil retainer 10 attached to her shirt or garment 70. A portion of the wire 30 of a headphone set 35 is configured into a wire coil 13 and retained by the wire coil retainer 10. A portion of her shirt is pulled through the interior of the wire coil retainer and retained therein. This configuration allows the wire coil retainer and a wire coil 13 to be retained in any suitable location on a garment.

As shown in FIG. 19, a person 71 running has an exemplary wire coil retainer 10 attached to her shirt.

As shown in FIG. 20, an exemplary wire coil retainer 10 has a portion of a garment 70 pulled through the interior 72 of the contiguous band 20.

As shown in FIG. 21, the exemplary wire coil retainer 10 shown in FIG. 20 has the fastening feature attached 40. The portion of the garment extending through the interior of the band 20 is pinched between and retained by the fastening feature 40. A fastening feature comprising a magnet enables retention of a portion of a garment pulled through the interior of the band by a wire coil retainer 10. A person may store the wire coil retainer on an article of clothing, as shown in FIG. 21 without a wire retained therein. A person may go the gym, remove a headphone set from a wire coil retainer, and then store the wire coil retainer on a portion of their clothing while they exercise. A wire coil retainer with at least one magnet may be stored on any magnetic metal, such as a refrigerator or piece of exercise apparatus.

As shown in FIG. 22, the exemplary wire coil retainer 10 shown in FIG. 20 has a portion of a garment 70 pinched by the fastening feature 40 and a wire coil 13 retained in a first 22 and second loop 23. The outer diameter of the wire coil Dc is shown being retained within the wire coil retainer 10, or within the interior or within the inside surface 21 of the wire coil retainer.

As shown in FIG. 23, a wire coil 13 is formed around three fingers 82 of a person's hand 80. A person may quickly form a wire coil by wrapping a wire around one or more fingers and then insert the wire coil into an exemplary wire coil retainer, as described herein, to retain the wire coil.

As shown in FIG. 24, an exemplary wire coil retainer 10 has a magnetic fastener portion 46 on an outside surface 24 of the band 20 and a magnetic metal fastener portion 47 partially embedded into the band material, whereby the magnetic metal fastener portion is flush with the inside surface 21 of the band.

As shown in FIG. 25, the exemplary wire coil retainer shown in FIG. 24 has the fastening feature 40 attached. The inside surface 21 of the band 20 is contacting itself between the first side 26 and second side 47. The inside surface 21 of the band is flush since one fastener portion is on the outside surface and the second fastener portion is embedded into the band and flush with the inside surface.

As shown in FIG. 26, an exemplary wire coil retainer 10 has a first magnetic fastener portion 46 on a first side 26 outside surface 24 of the band 20 and a second magnetic fastener portion 46' on a second side 27 outside surface of the band. The inside surface of the band is smooth, as there are no fasteners protruding from the inside surface. In this embodiment, the band comprises fastening features only on the outside surface of the band.

As shown in FIG. 27, the exemplary wire coil retainer 10 shown in FIG. 26 has the fastener 40 attached. The inside surface 21 of the hand 20 has been brought into contact to form a first 22 and a second loop 23. The first side 26 of the band has been brought into contact with the second side 27 of the band.

As shown in FIG. 28, an exemplary wire coil retainer 10 comprises a first fastener portion 42 and a second fastener portion 44 that are embedded into the band 20. The fastener portions are embedded into the band, such as through molding around the fastener portion or portions. No portion of the fastener is exposed in this embodiment and the band has a smooth outer surface.

As shown in FIG. 29 shows a top-down view of the exemplary wire coil retainer 10 shown in FIG. 28 with the fastening feature 40 attached. This band has a smooth outer surface. The thickness of the band may be greater where the fastener portions are located.

FIG. 30A shows a top-down view of the head 93 of an exemplary post 92 configured to attach a magnet to a band through a band opening. FIG. 30B shows a side view of the exemplary post 92 shown in FIG. 30A. The post has a post head and an extension 95 having retaining ridges 94.

As shown in FIG. 31, an exemplary magnet 46 has an aperture 98 therethrough. The extension 95 of the post shown in FIG. 30B may be inserted through the magnet aperture 98 and the retaining ridges 94 will retain and attach the post to the magnet.

As shown in FIG. 32, an exemplary wire coil retainer 10 has magnets 46, 46' attached to the band 20 with a post 92 configured through a band opening 99. A first magnet 46 is configured on the inside surface 21 of a first side 26 of the band, and a second magnet is configured on the outside surface 24 of a second side 27 of the band 20. In this configuration, the first magnet is configured on an inside surface and the second magnet is configured on an outside surface of the band. The first magnet will be pulled toward the second magnet and contact the head 93' of the second post 92'. This type of arrangement may be used when the pull-apart force of the two magnets is high and separating them by the band and/or a post head may make pulling the attached band apart easier.

As shown in FIG. 33, the exemplary wire coil retainer 10 shown in FIG. 32 has the fastening feature 40 attached.

EXAMPLE

A wire coil retainer as generally shown in FIG. 32 and FIG. 33 was made by attaching a first magnet to a first side of a band and a second magnet to a second side of a band with posts having an extension with retaining ridges. Silicone bands having a circumference of approximately 6 inches, a width of approximately 0.5 inch, and a thickness of approximately 0.070 inch, available from Wristbands With A Message Inc., Stafford, Tex., style, super/under size part number Green PMS354, were punched with a 3 mm hole punch to form the band opening for the insertion of the post. The band openings were made 180 degrees apart from each other around the band, or approximately one-half the circumference of the band from each other. Plastic posts available from The Fastener Warehouse, Mission Viego, Calif., part number TR249B were inserted through the band openings as shown in FIG. 32. Magnets having an aperture available from Applied Magnets, Plano, Tex., were then attached to the post. The magnets were Neodymium magnets having a ⅜"×⅛" tapered hole. The magnets were attached to the post extensions by inserting the magnet aperture over the end of the post extension and forcing the magnet over the retaining ridges. The thickness of the plastic head was about 0.070 inch, and the thickness of the silicone band was 0.070 inch, thereby making the magnet separation distance, when the fastener feature was attached being 0.140 inch. The magnets had a 3.5 lb-force pull-apart force and the separation distance between the two magnets provided sufficient holding or retention force between the first and second magnet to retain a wire in the wire coil retainer, Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

Wire, as used herein, refers to a wire or cord, such as those used for electronic devices. A wire may be an electronic device type wire that is configured to carry an electrical signal or transmit electric energy to an electronic device.

The phrase "fastening feature configured to detachably attach a first side of said contiguous band to a second side of said contiguous band" means that the first side of the band is pulled toward and retained to a second side and may be in contact with the second side or a fastener, post, snap, and the like may couple the first side to the second side, whereby the first side does not actually contact the second side, as shown and described herein.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A wire coil retainer comprising:

a) a contiguous band comprising:

i) an inside surface;

ii) a circumference;

b) a fastening feature configured to detachably attach a first side of said contiguous band to a second side of said contiguous band to create a first loop and a second loop, wherein the fastening feature comprises:

a first fastener portion configured on a first side of the contiguous band, and a second fastener portion configured on a second, and opposing side of said contiguous band from said first fastener portion;

wherein the fastening feature comprises a magnet:

whereby when said fastening feature is fastened, said first loop is configured on a first side of said fastening feature, and said second loop is configured on a second, and opposing, side of said fastening feature, wherein said contiguous band is a flexible single piece of material that is not detachable around the circumference;

whereby said wire coil retainer is configured to retain a wire coil having a coil opening and a coil perimeter, whereby when said wire coil is retained in said wire coil retainer, a first portion of said wire coil is retained in said first loop and a second portion of said wire coil is retained in said second loop and said fastening feature is fastened within a center opening of said wire coil and whereby said coil perimeter is retained within said contiguous band.

2. The wire coil retainer of claim 1, wherein the first fastener portion comprises a magnet and the second fastener portion comprises a magnet.

3. The wire coil retainer of claim 2, wherein the magnet is configured on an outside surface of the band.

4. The wire coil retainer of claim 1, wherein the first fastener portion is at least partially embedded in the band.

5. The wire coil retainer of claim 1, wherein the first and a second fastener portions are both completely embedded in the band, whereby the band has a smooth inside surface.

6. The wire coil retainer of claim 1, wherein the first fastener portion comprises a magnet and the second fastener portion comprises a magnetic metal.

7. The wire coil retainer of claim 1, wherein the first fastener portion comprises a first magnet and the second fastener portion comprises a second magnet;

wherein said first magnet has a north polarity facing toward said second magnet, and said second magnet has a south polarity facing toward said first magnet, whereby said first and second magnets are attracted to each other to detachably attach the first side of said contiguous band to the second side of said contiguous band.

8. The wire coil retainer of claim 1, wherein the fastening feature is configured substantially in the center of the contiguous band, whereby loops of substantially the same size are created on either side of said fastener when said fastener detachably attaches the first side of said contiguous band to the second side of said contiguous band.

9. The wire coil retainer of claim 1, wherein the circumference of the cont contiguous band is no more than about 20 inches.

10. The wire coil retainer of claim 1, wherein the contiguous band has a width of no more than about 1 inch.

11. The wire coil retainer of claim 1, wherein the contiguous band further comprises a plurality of retainer protrusions;

whereby when the fastening feature detachably attaches the first side of said contiguous band to the second side of said contiguous band at least one retainer protrusion is configured in each of the first loop and the second loop.

12. The wire coil retainer of claim 11, wherein a first retainer protrusion configured on a first inside surface of a first side of the contiguous band is configured to nest with a second protrusion configured on a second inside surface of a second side of said contiguous band when said fastening feature detachably attaches the first side of said contiguous band to the second side of said contiguous band.

13. The wire coil retainer of claim 1, wherein the contiguous band is a free-standing band.

14. The wire coil retainer of claim 1, wherein the contiguous band consists essentially of an elastomer.

15. A wire coil retainer comprising:

a) a contiguous band comprising:

i) an inside surface;

ii) a circumference;

b) a fastening feature configured to detachably attach a first side of said contiguous band to a second side of said contiguous band to create a first loop and a second loop, wherein the fastening feature comprises a magnet:

whereby when said fastening feature detachably attaches said first side of said contiguous band to said second side of said contiguous band, said first loop is configured on a first side of said fastening feature, and said second loop is configured on a second, and opposing, side of said fastening feature, whereby said wire coil retainer is configured to retain a wire coil having a center opening and a coil perimeter;

whereby when said wire coil is retained in said wire coil retainer, a first portion of said wire coil is retained in said first loop and a second portion of said wire coil is retained in said second loop, said fastening feature is fastened within said center opening of said wire coil and a perimeter of said wire coil is retained within said contiguous band, wherein said contiguous band is a flexible single piece of material that is not detachable around the circumference and consists essentially of an elastomer, and wherein said contiguous band is a free-standing band.

16. The wire coil retainer of claim 15, wherein the fastening feature is configured substantially in the center of the contiguous band, whereby loops of substantially the same size are created on either side of said fastener when said fastener detachably attaches the first side of said contiguous band to the second side of said contiguous band.

* * * * *